US007939737B2

(12) United States Patent
Erismann

(10) Patent No.: US 7,939,737 B2
(45) Date of Patent: May 10, 2011

(54) BODY SUPPORT FOR A GUITAR OR SIMILAR MUSICAL INSTRUMENTS

(75) Inventor: Mark Erismann, Aarau (CH)

(73) Assignee: Triff Aktiengesellschaft, Aarau (CH)

( * ) Notice: Subject to any disclaimer, the term of this patent is extended or adjusted under 35 U.S.C. 154(b) by 0 days.

(21) Appl. No.: 12/449,574

(22) PCT Filed: Feb. 12, 2008

(86) PCT No.: PCT/CH2008/000053

§ 371 (c)(1),
(2), (4) Date: Aug. 13, 2009

(87) PCT Pub. No.: WO2008/101357

PCT Pub. Date: Aug. 28, 2008

(65) Prior Publication Data

US 2010/0089218 A1 Apr. 15, 2010

(30) Foreign Application Priority Data

Feb. 21, 2007 (CH) ..... 290/07

(51) Int. Cl.
*G10D 3/00* (2006.01)

(52) U.S. Cl. ..... 84/327

(58) Field of Classification Search ..... 84/327, 84/329, 421, 453
See application file for complete search history.

(56) References Cited

U.S. PATENT DOCUMENTS

| | | | | |
|---|---|---|---|---|
| 3,771,408 | A | 11/1973 | Wright | |
| 6,188,005 | B1 | 2/2001 | White | |
| 6,664,461 | B2 | 12/2003 | Tamura | |
| RE40,097 | E | 2/2008 | Erismann | |
| 2010/0126329 | A1 * | 5/2010 | Bowen | 84/327 |

FOREIGN PATENT DOCUMENTS

| | | |
|---|---|---|
| DE | 8232675 | 5/1983 |
| DE | 82326754 | 5/1983 |
| EP | 1123543 | 11/2003 |

* cited by examiner

*Primary Examiner* — Kimberly R Lockett
(74) *Attorney, Agent, or Firm* — Horst M. Kasper

(57) ABSTRACT

The body support (2) for a guitar (1) or similar musical instruments can be removed and is shaped like a frame. It comprises a single bass clef-shaped body, the two ends (3,4) of which are attached to the guitar body (5) at a distance from each other. The body support (2) protrudes on both sides and at the end of the guitar body (5), thus facilitating the handling of the guitar (1) and accessibility to the tuning elements (6). An elastic padding (12) is provided in the holding region of the body support (2). The body support can be removed and folded for transporting the guitar (1).

20 Claims, 9 Drawing Sheets

BODY SUPPORT FOR A GUITAR OR SIMILAR MUSICAL INSTRUMENTS

The present invention relates to a body support for a guitar or similar musical instruments with a detachable, frame-shaped body support.

A detachable, frame-shaped body support for a guitar or similar musical instruments is known from EP-B1-1123543. This body support is composed of a plurality of shaped, rigid, rod-shaped support elements. In order to attain the required stability of the body support, an additional support element is provided between the two opposing, lateral support elements of the frame-shaped body support. This additional support element is used at the same time for one fastening of the body support to the carcass. The other fastening takes place on a support element passed below the carcass. At the end of the carcass, the body support is set apart from the carcass, as a result of which the body support causes an extension of the mounting of the musical instrument and promotes accessibility to the tuning members of the musical instrument. The additional support element is positioned transversely between the two laterally opposing support elements, resulting in additional costs and complications during collapsing of the detached body support.

The object of the present invention is to economically simplify the body support mentioned at the outset and to advantageously configure the collapsing of the separated-off body support.

The object set is achieved in that the body support consists of a single bass clef-shaped body, both ends of which are fastened to the guitar body, the body support protruding from the guitar body on both sides and at the end of the guitar body and one end of the body support facing from one side and the other end of the body support facing from the other side toward the guitar body and being fastened thereto, set apart from each other. These measures simplify the body support and the collapsing thereof. The cost advantages are obvious.

The free ends of the body support advantageously protrude beyond the fastening point at the fastening points. This measure promotes the bending strength of the body support at the fastening points.

Advantageously, at least one stop for the body support is provided on the guitar body in the region of the fastening point. This stop ensures that the body support remains in position on the guitar body.

The body support can consist of at least two interconnected parts. The dismantled parts of the body support facilitate packaging and transportation of the body support.

Cords holding the adjacent parts of the body support together in a spaced, non-interchangeable and captive manner after release of the plug-in connection can be fastened to two mutually insertable parts of the body support. This arrangement is advantageous because, after release of the plug-in connection between the parts of the body support, said parts continue to hang together at least loosely, so that there is no need to search for the associated parts during reassembly. This measure greatly facilitates handling of the body support. Advantageously, the cords, which are positioned between the associated parts, are elastic.

Advantageously, the body support has a projection reaching at least up to the region of the center of gravity of the musical instrument as a whole. A carrying strap can be fastened to this projection, as a result of which the musical instrument, which the player plays standing upright, assumes a stable position.

The body support consists advantageously of round material. Suitable round materials are commercially available.

The body support can also consist of flat material. Flat material is simple to machine.

The body support can be provided with an anti-slip coating. This coating allows safe, slip-free handling of the musical instrument.

Exemplary embodiments of the invention will be described hereinafter in greater detail with reference to the appended drawings, in which.

Figure 1:
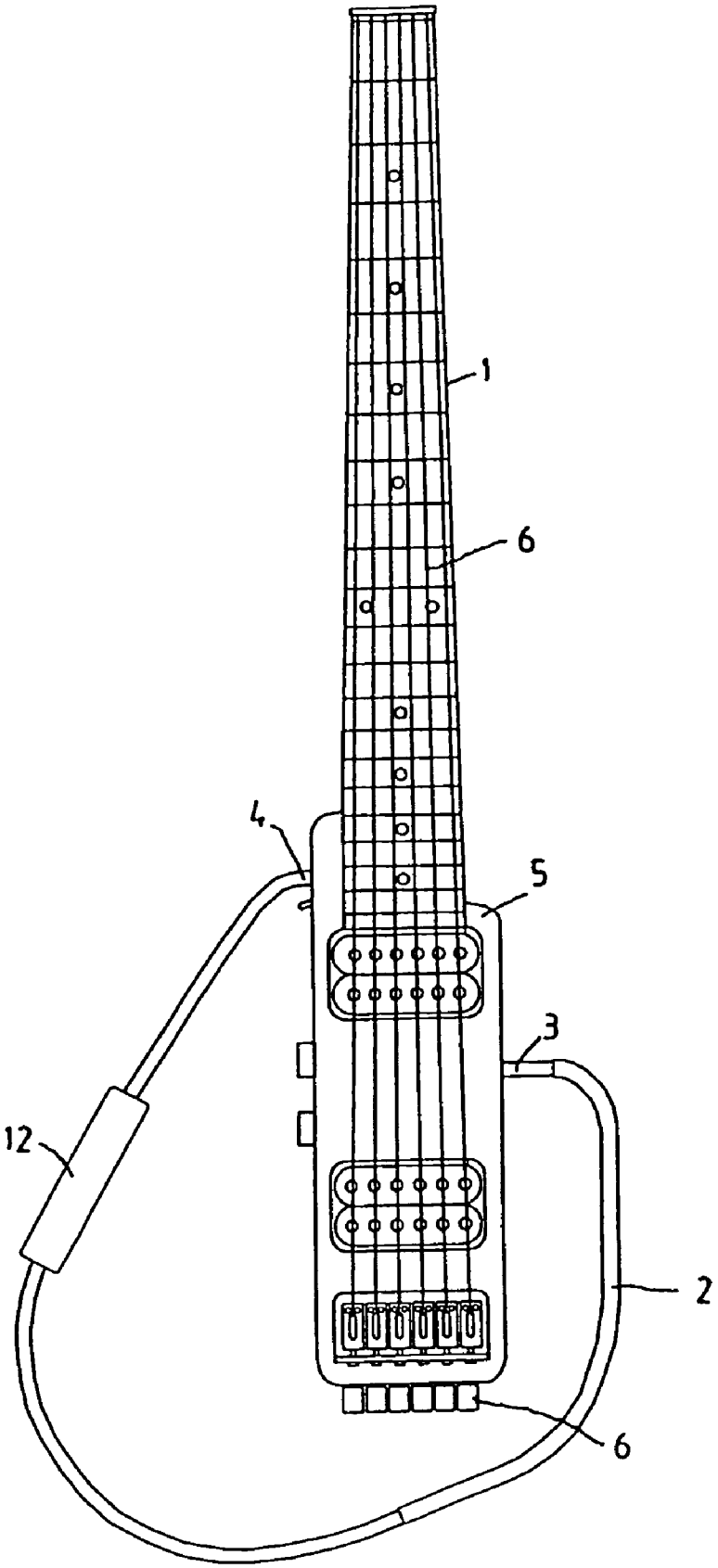
FIG. 1 is the plan view of a guitar with a detachable body support.
Figure 2:
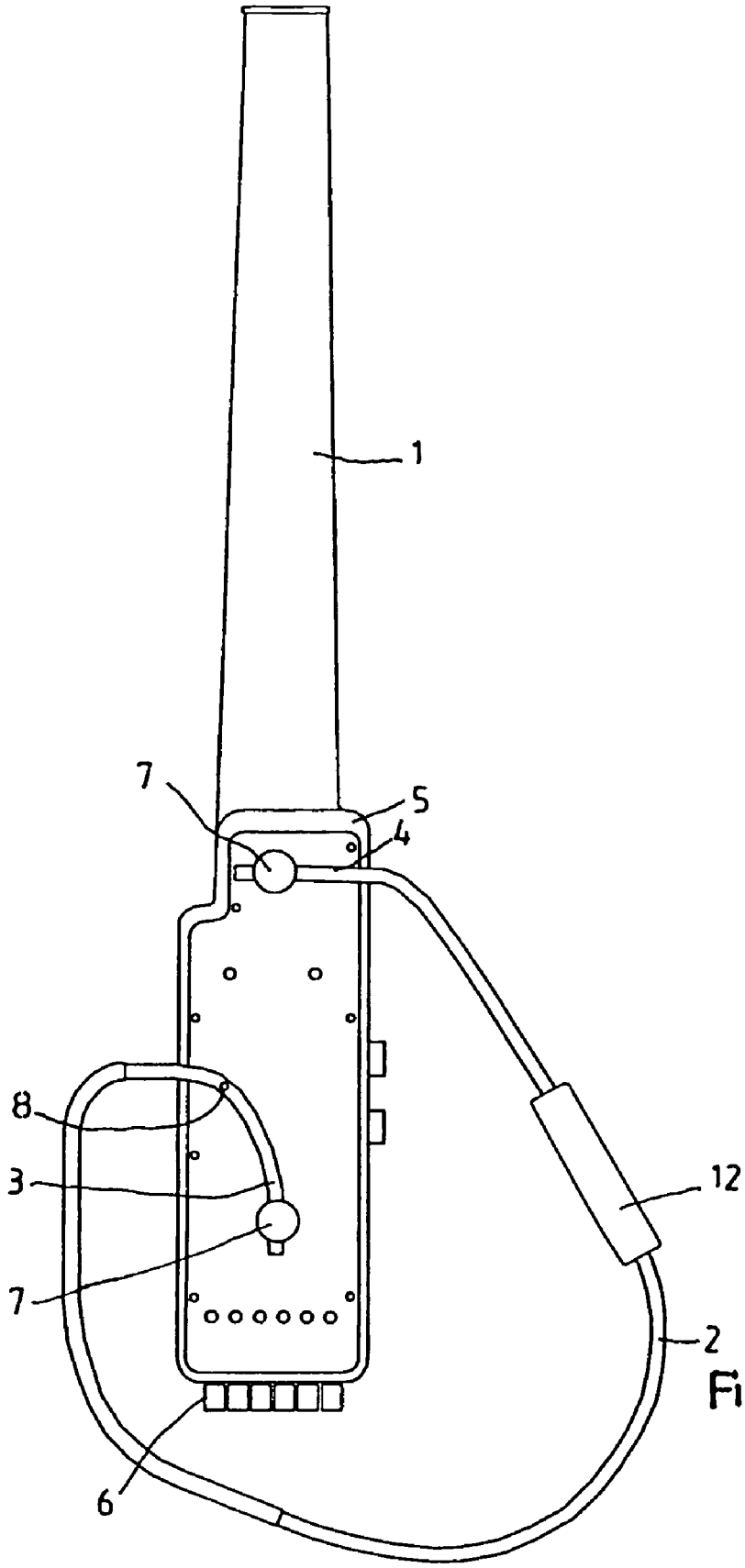
FIG. 2 shows the same guitar from the side remote from the strings.

FIG. 1 is the plan view of a guitar 1 with a detachable body support 2 having the shape of a bass clef. The two ends 3, 4 of the body support 2 are fastened to the guitar body 5, as may also be seen in FIG. 2 from the side of the guitar body 5 that is remote from the strings 6. On both sides of the guitar body 5, the body support 2 is set apart from the guitar body 5. This measure affords pleasant handling of the guitar 1 and good accessibility to the tuning members 6 of the guitar. The ends 3, 4 of the body support 2 face the guitar body 5 from the opposing sides. The body support 2 is fastened to the guitar body 5 using screws 7 (FIG. 2). The free ends 3, 4 of the body support 2 protrude beyond the fastening point, allowing the bending strength to be increased at this location.

A pin, which protrudes into a hole in the body support 2 and is fastened to the guitar body 5, is provided as a stop 8 in the region of the point at which the body support 2 is fastened to the guitar body 5, as shown in FIG. 2. This stop helps to secure the position of the body support 2 on the guitar body 5.

Figure 3:
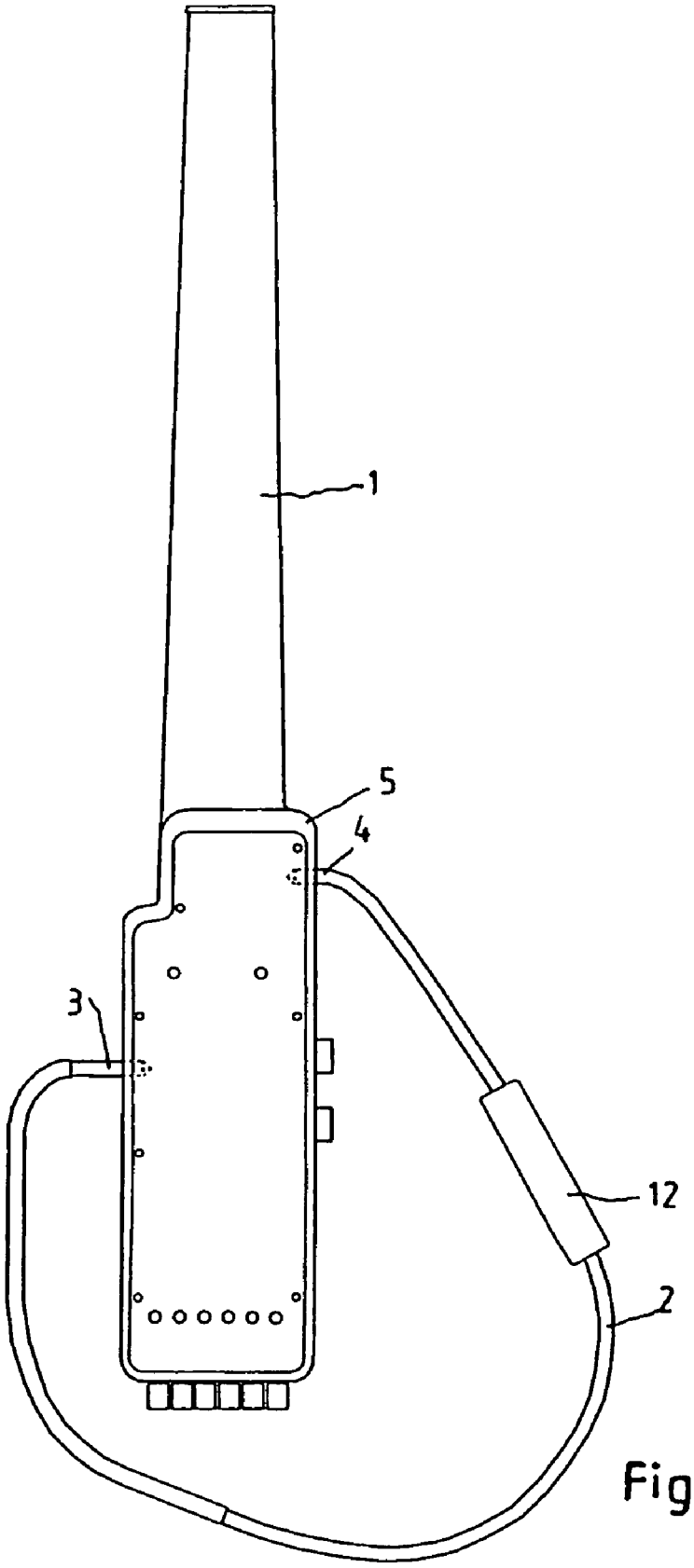
FIG. 3 shows the body support inserted into the guitar body.

FIG. 3 shows a further variant of the arrangement of the body support 2 on the guitar body 5. The guitar body 5 is shown from the side remote from the strings. In this arrangement, the ends 3, 4 of the body support 2 are inserted into holes in the guitar body 5. Known securing means, such as for example spring elements, are provided to prevent the ends from falling out of the holes.

Figure 4:
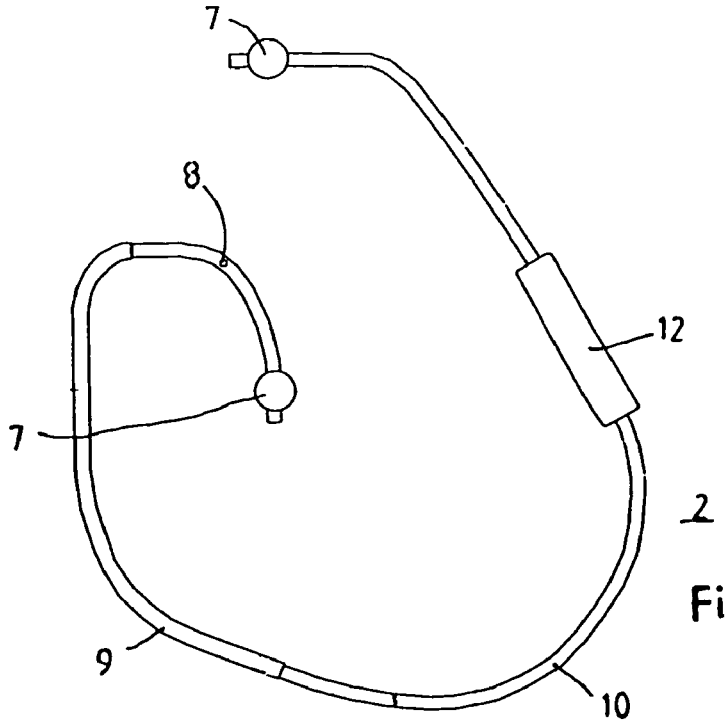
FIG. 4 shows the body support without a guitar.
Figure 5:
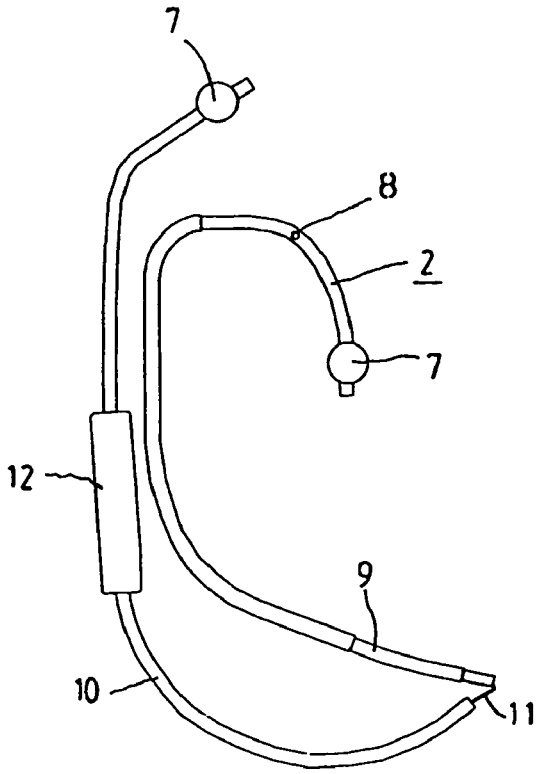
FIG. 5 shows the collapsed body support with two separated parts.

FIG. 4 shows the body support 2 without a guitar body 5. The body support consists of two interconnected parts 9 and 10. In FIG. 5, the two parts 9, 10 are separated from each other for transportation. This figure, FIG. 5, clearly shows that the separated parts 9, 10 are held captively together by an elastic cord 11. This measure eliminates the need for unnecessary searches for the associated connections of the parts 9, 10 of the body support 2 during assembly of the body support 2. The part 9 of the body support 2 carries over the majority of its surface area an anti-slip coating. The part 10 is provided in the region for manual holding of the body support 2 with an elastic pad 12.

Figure 6:
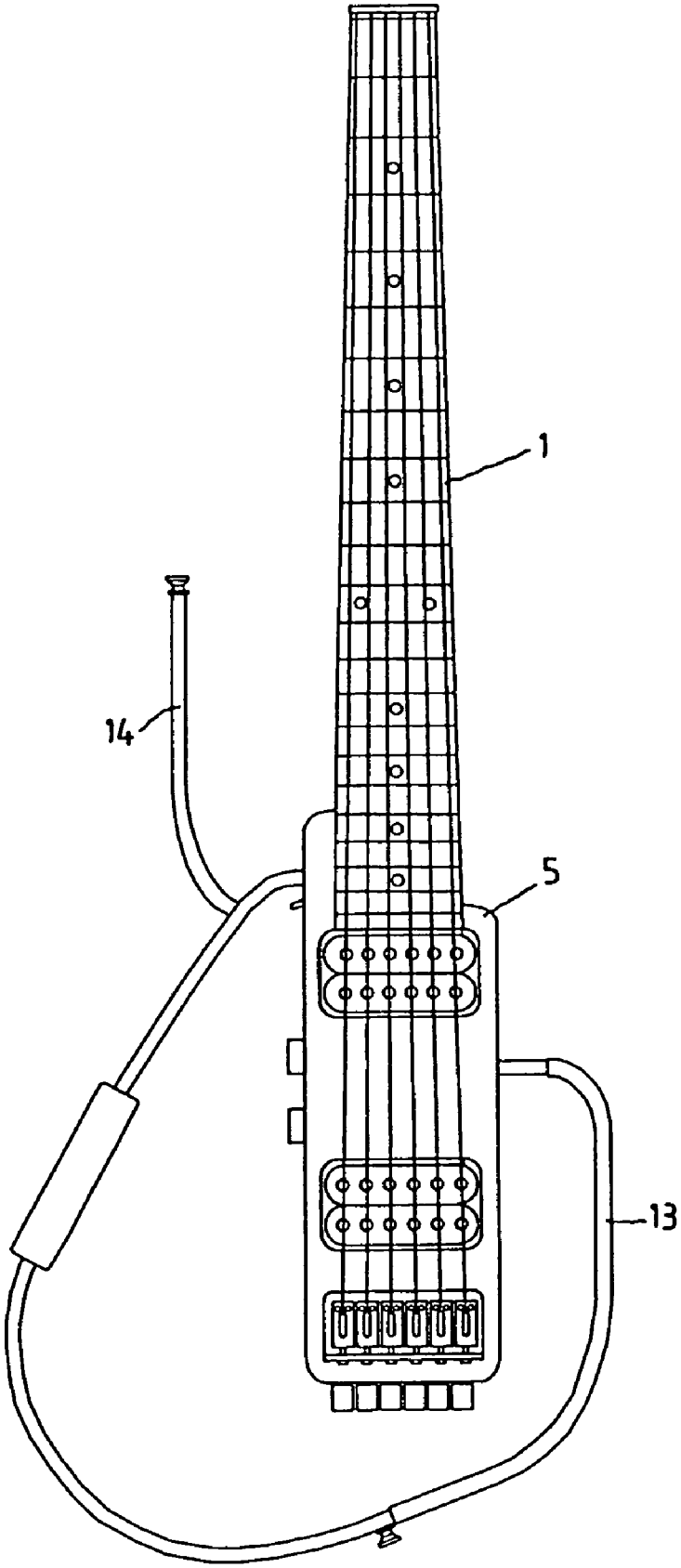
FIG. 6 is the plan view of a guitar with a body support, the body support carrying a lateral projection.

FIG. 6 shows a further guitar 1 with a supplemented body support 13. This body support 13 has a projection 14 extending up to the region of the center of gravity of the guitar 1 as a whole. A carrying strap (not shown) can be fastened to the end of this projection 14. This suspension arrangement allows the guitar 1, which the player carries standing upright, to remain in the selected and desired position; it tilts neither toward the right nor toward the left, leaving the player to play away undisturbed.

Figure 7:
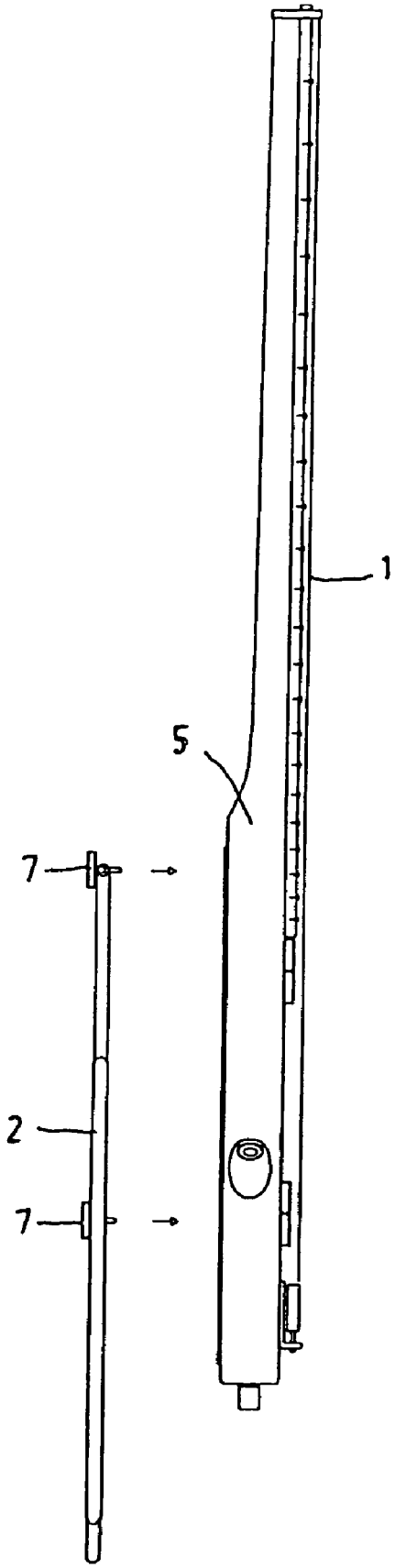
FIG. 7 is the side view of a guitar with a body support prior to assembly.
Figure 8:
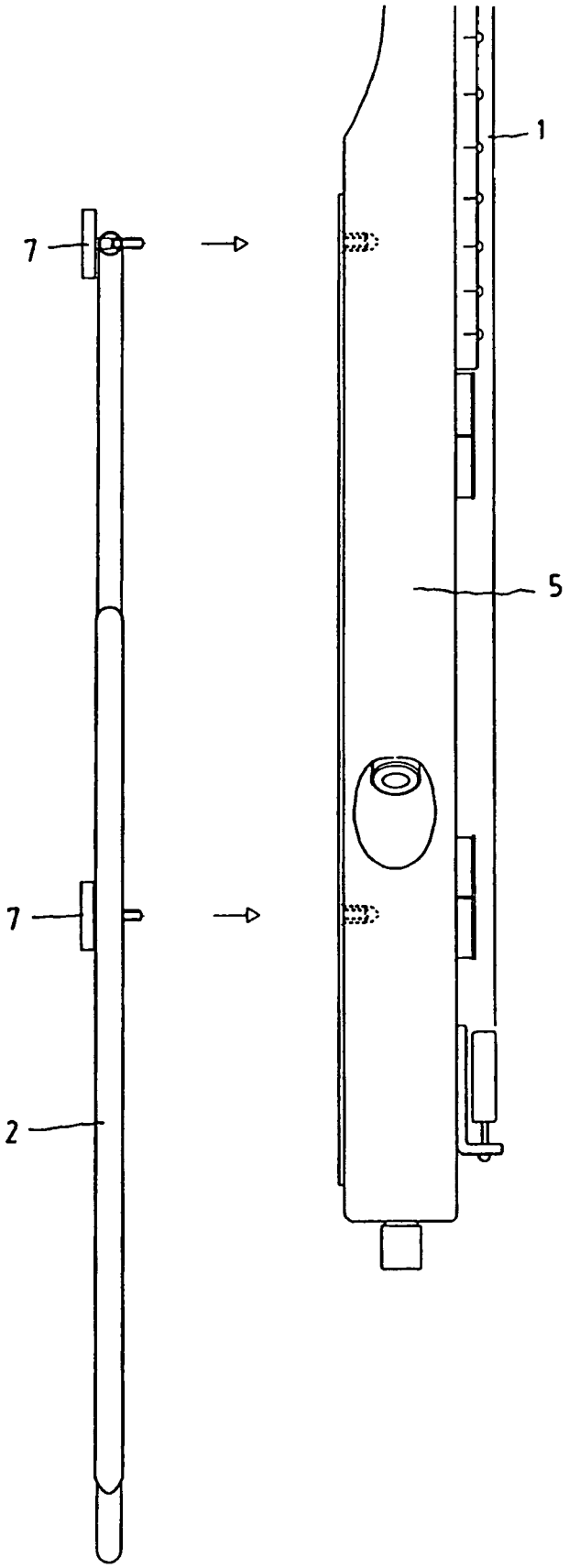
FIG. 8 is the side view of a part of a guitar with a body support made of round material prior to assembly.

FIG. 7 and FIG. 8 show a guitar 1 or at least a portion of a guitar 1 with the body support 2 to be attached. The body support 2 is made of a round material and is screwed onto the guitar body 5 using screws 7, as previously shown in FIG. 2.

Figure 9:
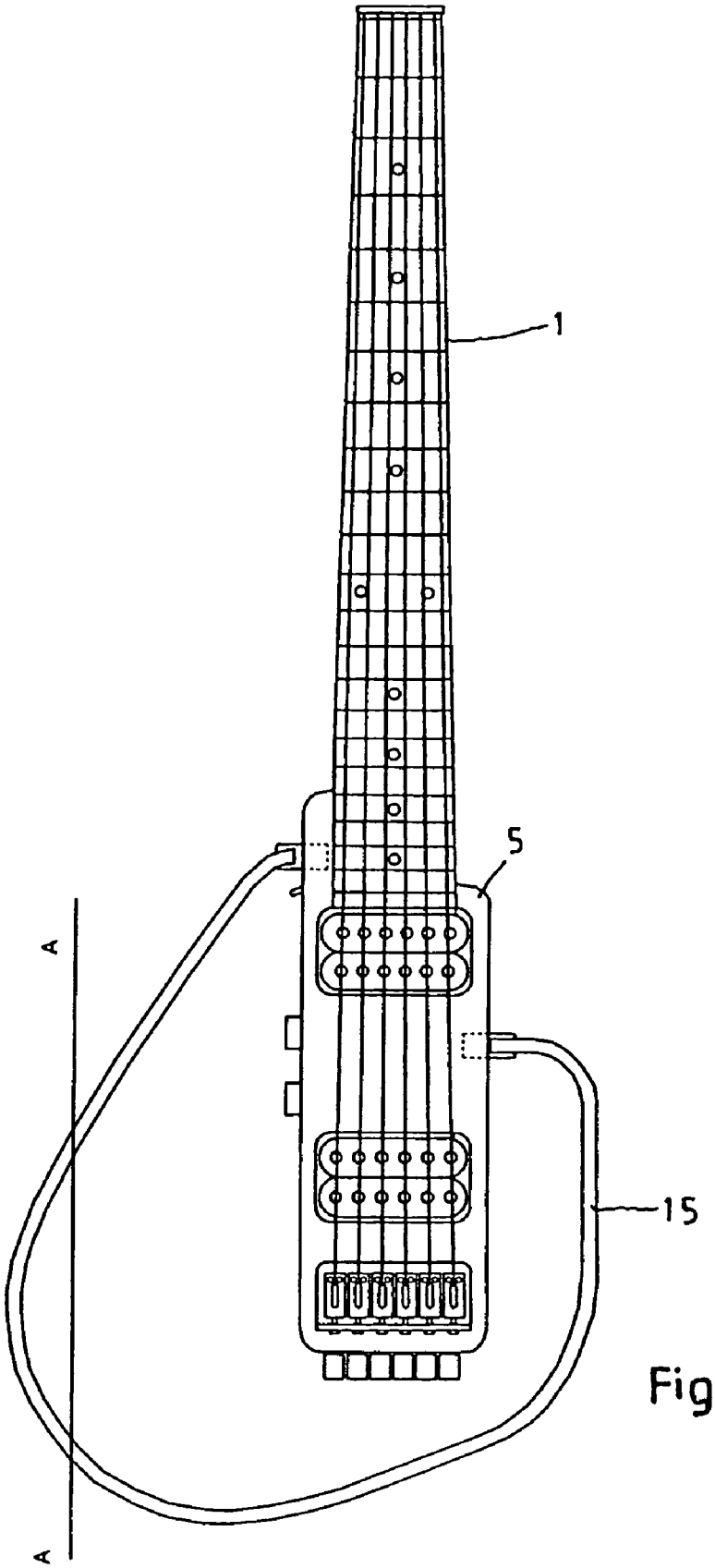
FIG. 9 is the plan view of a guitar with a body support made of flat material.
Figure 10:
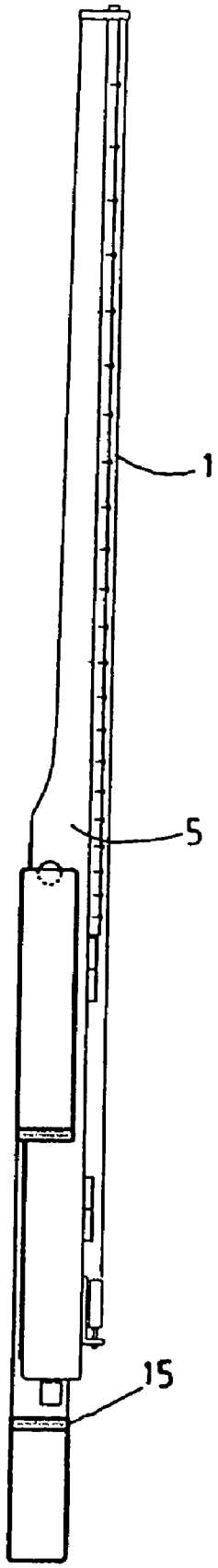
FIG. 10 shows the same guitar with a cut through the body support.

The body support 15 can also be made of flat material, as may be seen from FIGS. 9 and 10. FIG. 9 shows a guitar 1 with a body support 15 made of flat material. FIG. 10 is a sectional image along the line A-A in FIG. 9. A body support 15 can be bent very easily from flat material. It is also possible to join this body support using at least one hinge made of at least two parts and to design it so as to be collapsible in this way, as shown in FIG. 5 for mutually insertable parts.

These exemplary embodiments related to a guitar 1. The described body support 1, 13, 15 can also be applied in other suitable, similar musical instruments.

The invention claimed is:

1. A body support frame for a guitar or similar musical instruments with a detachable, frame-shaped body support (2, 13, 15), characterized in that the detachable, frame-shaped body support (2, 13, 15) consists of a single bass clef-shaped body, wherein two ends (3, 4) of the single bass clef-shaped body are fastened to the guitar body (5), the detachable, frame-shaped body support (2, 13, 15) protruding and projecting from the guitar body (5) on two sides and at an end of the guitar body (5) and one end (3) of the detachable, frame-shaped body support (2) facing from one side and another end (4) of the detachable, frame-shaped body support (2, 13, 15) facing from another side toward the guitar body (5) and being fastened thereto, set apart from each other.

2. The body support as claimed in claim 1, characterized in that the free ends (3, 4) of the detachable, frame-shaped body support (2) protrude beyond a respective fastening point at the guitar body (5).

3. The body support as claimed in claim 2, characterized in that at least one stop (8) is provided for the detachable, frame-shaped body support (2) on the guitar body (5) in a region of the respective fastening point.

4. The body support as claimed in claim 1, characterized in that the detachable, frame-shaped body support (2) consists of at least two interconnected parts (9, 10).

5. The body support as claimed in claim 4, characterized in that cords (11) holding the adjacent parts (9, 10) of the detachable, frame-shaped body support (2) together in a spaced, non-interchangeable and captive manner after release of the plug-in connection are fastened to two mutually insertable parts (9, 10) of the detachable, frame-shaped body support (2).

6. The body support as claimed in claim 5, characterized in that the cords (11) are elastic.

7. The body support as claimed in claim 1, characterized in that the body support (13) has a lateral projection (14) reaching at least up to a region of a center of gravity of a musical instrument as a whole.

8. The body support as claimed in claim 1, characterized in that the detachable, frame-shaped body support (2, 13) consists of round material.

9. The body support as claimed in claim 1, characterized in that the detachable, frame-shaped body support (15) consists of flat material.

10. The body support as claimed in claim 8, characterized in that the detachable, frame-shaped body support (2, 13, 15) is provided with an anti-slip coating.

11. A body support frame for a guitar or similar musical instruments comprising a single bass clef-shaped body having a first end (3) fastened to a guitar body (5) and having a second end (4) fastened to the guitar body (5), wherein the single bass clef-shaped frame (2, 13, 15) protrudes and projects on a first side of the guitar body (5), wherein the single bass clef-shaped frame (2, 13, 15) protrudes and projects on a second side of the guitar body (5), wherein the single bass clef-shaped frame (2, 13, 15) protrudes and projects on an end of the guitar body (5), and wherein the first end (3) faces and is fastened to the first side of the guitar body (5), and wherein the second end (4) faces and is fastened to the second side of the guitar body (5), and wherein the first end (3) and the second end (4) are set apart from each other.

12. The body support frame as claimed in claim 11, wherein the first end (3) of the single bass clef-shaped frame protrudes and projects beyond a first fastening point at the guitar body (5), and wherein the second free end (4) of the single bass clef-shaped frame protrudes and projects beyond a second fastening point at the guitar body (5) and wherein the body support frame at its first end (3) is aligned with a longitudinal direction of the guitar (5) and wherein the body support frame (2) at its second end (4) is disposed perpendicular to the longitudinal direction of the guitar (5).

13. The body support frame as claimed in claim 12 further comprising a pin (8) which protrudes into a hole in the body support frame (2) at which hole the body support frame (2) is fastened to the guitar body (5), wherein at least one stop is provided for the body support frame (2) on the guitar body (5) in a region of the first fastening point.

14. The body support frame as claimed in claim 11, wherein the detachable, frame-shaped body support (2) consists of at least two interconnected parts (9, 10) and wherein one (10) of the interconnected parts is provided with an elastic pad (12) in the region for manual holding of the body support frame.

15. The body support frame as claimed in claim 14, wherein elastic cords (11) are holding the adjacent parts (9, 10) of the single bass clef-shaped frame (2) together in a spaced, non-interchangeable and captive manner after release of the plug-in connection and are fastened to two mutually insertable parts (9, 10) of the single bass clef-shaped frame (2).

16. The body support frame as claimed in claim 11, wherein the body support (13) has a lateral projection (14) reaching at least up to a region of a center of gravity of a musical instrument as a whole and wherein a carrying strip fastened to an end of this projection (14), wherein a suspension arrangement allows the guitar (1) to remain in a selected and desired position.

17. The body support frame as claimed in claim 11, wherein the detachable, frame-shaped body support (2, 13) consists of a round material, and wherein the round material is screwed onto the guitar body using screws (7).

18. The body support frame as claimed in claim 11, wherein the detachable, frame-shaped body support (15) consists of a flat material, wherein the body support frame is bent and wherein the body support frame at its first end (3) is disposed perpendicular to a longitudinal direction of the guitar (5) and wherein the body support frame (2) at its second end (4) is disposed perpendicular to the longitudinal direction of the guitar (5).

19. The body support frame as claimed in claim 17, wherein the detachable, frame-shaped body support (2, 13, 15) is provided with an anti-slip coating.

20. A body support frame for a guitar or similar musical instruments comprising a single bass clef-shaped frame having a first end (3) fastened to a guitar body (5) and having a second end (4) fastened to the guitar body (5), wherein the single bass clef-shaped frame (2, 13, 15) protrudes and projects on a first side of the guitar body (5), wherein the single bass clef-shaped frame (2, 13, 15) protrudes and projects on a second side of the guitar body (5), wherein the single bass clef-shaped frame (2, 13, 15) protrudes and projects on an end of the guitar body (5), and wherein the first end (3) of the single bass clef-shaped frame faces and is fastened to the first side of the guitar body (5) and wherein the second end (4) of the single bass clef-shaped frame faces and is fastened to the second side of the guitar body (5) and wherein the first end (3) and the second end (4) are set apart from each other.

* * * * *